United States Patent [19]

Dingwall

[11] 4,038,963

[45] Aug. 2, 1977

[54] HEATING SYSTEM USING OUTSIDE AIR

[76] Inventor: Gloria L. Dingwall, Hamlin Road, Mahopac, N.Y. 10541

[21] Appl. No.: 656,398

[22] Filed: Feb. 9, 1976

[51] Int. Cl.[2] ..... F24C 3/00

[52] U.S. Cl. ..... 126/85 B; 98/48

[58] Field of Search ..... 126/85 B; 137/527; 98/48; 237/53

[56] References Cited

U.S. PATENT DOCUMENTS

| | | | |
|---|---|---|---|
| 2,711,683 | 6/1955 | Ryder | 126/85 B X |
| 2,764,972 | 10/1956 | Ryder | 126/85 B X |
| 3,805,764 | 4/1974 | Dyer | 126/85 B X |
| 3,906,925 | 9/1975 | Dyer | 126/85 B X |

*Primary Examiner*—William E. Wayner
*Assistant Examiner*—William E. Tapolcai, Jr.
*Attorney, Agent, or Firm*—Friedman, Goodman & Teitelbaum

[57] ABSTRACT

A heating system having a furnace which intakes air for combustion purposes, and produces exhaust gases which are emitted through a flue pipe. One coupling device interconnects a draft opening in the flue pipe with the exterior of the building for allowing air outside of the building to provide the draft for the flue pipe. A second coupling device interconnects the air intake with the outside of the building for allowing use of air outside of the building as the air supply for the furnace.

12 Claims, 4 Drawing Figures

HEATING SYSTEM USING OUTSIDE AIR

BACKGROUND OF THE INVENTION

This invention relates to heating systems and more particularly to heating systems utilizing outside air.

In almost every building there is provided a heating system which utilizes a furnace having a combustion chamber. Regardless of whether it be a gas heater, an oil heater, or other types, the combustion chamber requires air to support burning of the fuel and exhaust gases are produced as a by-product of the combustion. The exhaust gases are generally emitted through a flue pipe which passes to the chimney and is thereby discharged from the building. The air for supporting combustion is generally provided by means of an air intake, usually built into the furnace. The air intake consists of an opening in the furnace wall having a grill or other air pervious cover through which the air around the furnace can pass into the furnace and to the combustion chamber.

A draft opening is usually located in the flue pipe, and a damper is frequently placed at the entrance of the opening. The draft is essential for the proper operation of the flue pipe to emit the flue gases to the chimney. One of the reasons for the draft opening is to insure an upward flow of the flue gases and prevent a reversal which would cause a backdraft into the furnace and might extinguish the fire. Another reason for such draft opening is that it permits a considerable quantity of air to be drawn from the inside of the building into the flue pipe along with the flue gases, thereby eliminating to a large extent condensation of water from the flue gases within the chimney. A further reason for the use of the draft opening is that it largely eliminates the effect of the chimney upon the furnace.

Furnaces are ordinarily constructed to have a pressure drop so that there will be a reduced pressure in the furnace to suck in a supply of air needed for support of combustion. The flow of the air through the draft opening insures that there will be no negative pressure at the furnace exhaust outlet. Were this not so, it would be difficult to balance the furnace to its own chimney condition so that the proper flow rate of air into the furnace would occur.

Therefore, the flow of air through the draft opening and into the flue pipe is of major importance in the proper operation of the furnace. Additionally, the flow of air directly into the furnace to support combustion is also of major importance. Without this air supply, improper combustion would take place and in many cases the fire might be completely extinguished.

In general, it has been the practice to vent the draft opening of the flue pipe directly to the air in the room in which the furnace is contained. Similarly, the air intake connects the furnace directly with the ambient air in the room in which the furnace is situated. As a result, the air in the immediate vicinity of the furnace is actually utilized for both air intake as well as for draft purposes.

In most cases, a furnace is situated directly within the building itself. Sometimes it is contained in its own private supply area, but frequently, it is in the basement or in a general working area of the building. Since the air around the furnace is sucked in through the flue pipe, the heated air within the room is actually being wasted since it will be exhausted out of the chimney. Such waste of heated air is most inefficient. Furthermore, since the air surrounding the furnace is sucked into the furnace to support combustion, there is a constant reduction in the amount of air in the area surrounding the furnace. As a result, fresh air must be drawn into the furnace room to resupply the void left by the air flowing into the furnace and out through the flue pipe.

When the area around the furnace is open and unrestricted, there is caused a constant drain on the heated air supply which is needed to replace the air used up by the furnace. This reduces the amount of heated air in the surrounding area and causes the furnace to operate excessively. Should the area around the furnace be enclosed in a separate room, it causes air to flow into the room through cracks and creaks in doors, windows and the like, which causes a drafty condition, as well as making the walls of the room cold, exposing any water pipes to the possibility of cold damage, and other detrimental effects.

SUMMARY OF THE INVENTION

It is accordingly an object of the present invention to provide a heating system which avoid the aforementioned problems of prior art devices.

Still another object of the present invention is to provide a heating system which can utilize outside air as the draft for the flue pipe.

Yet another object of the present invention is to provide a heating system which can utilize outside air for the air supply of a furnace.

Another object of the present invention is to provide a heating system utilizing a furnace, wherein both the air intake and draft are coupled to the outside air.

A further object of the present invention is to provide a heating system having a furnace with an air intake and exhaust, wherein outside air is generally provided for both the air intake and the draft, and wherein there is included a safety device which can cause inside air to be utilized for these purposes upon restriction of the flow of the outside air.

Yet another object of the present invention is to provide a heating system which utilizes improved coupling devices for coupling outside air to the flue pipe and for coupling outside air to the air intake of a furnace.

Briefly, the invention describes a heating system for heating a building and which includes a furnace having an inlet and an outlet. A flue pipe leads from the outlet to the exterior of the building to permit the escape of exhaust gases. A draft opening is contained in the flue pipe. An air intake pipe is coupled to the inlet of the furnace for receiving air into the furnace. First and second pipes are supplied, wherein a respective one of the ends of each of the pipes are coupled to the exterior of the building. A first coupling means inter-connects the other end of the first pipe to the draft opening for allowing air outside of the building to provide a draft to the flue pipe. A second coupling means is also provided, which interconnects the other end of the second pipe to the air intake pipe for allowing air outside of the building to be used as the air supply for the furnace.

In an embodiment of the invention, a safety means is provided on each of the coupling means to admit air from inside of the building when the air flow from outside the building becomes restricted.

BRIEF DESCRIPTION OF THE DRAWING

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing like reference characters designate like parts.

DESCRIPTION OF THE PREFERRED EMBODIMENT

Figure 1:
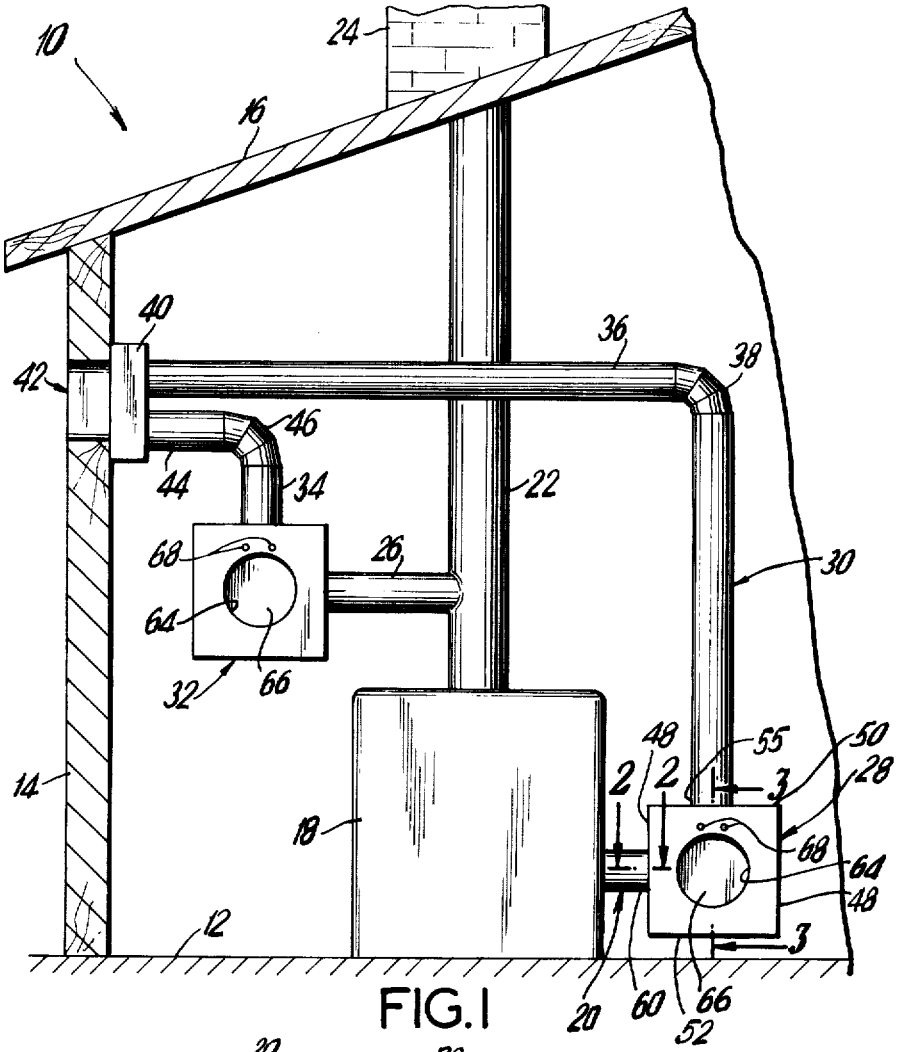
FIG. 1 is a schematic representation, partially in section, of a building having a heating system incorporating the present invention.

Referring to FIG. 1, there is shown a conventional building 10 having a floor 12, a sidewall 14, and a roof 16. Furnace 18 can be part of various types of conventional heating systems, including hot water systems, steam systems or forced air systems. It can utilize gas, oil or other fuels which require burning. Within the furnace, there is a conventional combustion chamber (not shown) in which the fuel is burned to produce heat, then transfers the heat to a fluid medium, which is then passed throughout the building to heat radiators, and other conventional heating fixtures (not shown).

In order to support the combustion of the fuel, it is necessary for air to be supplied to the combustion chamber. An air intake pipe 20 is provided to supply air at the intake or input to the combustion chamber. The exhaust gases produced are passed through the flue pipe 22 which is connected to the output of the furnace, and discharged to the outside of the house in a conventional manner by means of the chimney 24. A short pipe section 26 is connected to the flue pipe 22 to provide a flow of air which causes a draft in the flue pipe.

Generally, with most prior art systems, the air intake pipe 20 would be exposed to the inside of the building so that air from inside the building would be utilized to support the combustion within the furnace. Similarly, at the end of the air draft pipe 26, there would be placed a damper which would also interconnect the flue pipe to the in side of the building and permit the air inside of the building to be utilized as the proper draft for the flue pipe. In the present embodiment, there is attached a coupling device, shown generally at 28, between the air intake pipe 20 and a supply pipe 30, and similarly, a coupling device, shown generally at 32, is connected between the pipe 26 and a draft supply pipe 34.

The air supply pipe 30 is shown connected to a further pipe 36 by means of an elbow joint 38, and is interconnected to an air duct 40 positioned on the wall 14 of the building. The air duct 40 is coupled to an opening 42 in the wall for communication with the air outside of the building. The draft supply pipe 34 is also connected to a further pipe section 44 through an elbow joint 46, and is also coupled to the same air duct 40 to permit communication with the air outside of the building through the opening 42.

By means of the coupling devices 28, 32, outside air is permitted to flow through the opening 42 and provide the air supply to the air intake pipe 20, and also to flow into the draft pipe 26 to provide the proper draft for the flue pipe 22. Utilizing the arrangement shown, the air inside of the building is not wasted in the flue pipe and is also not used in the furnace itself for supporting combustion. Therefore, heated air surrounding the furnace can remain intact and will not be used up. Consequently, no other supply of air need constantly flow to the furnace room. On the other hand, because only outside air is supplied, there will be greater efficiency since no heated air is used up.

The coupling devices 28 and 32 can both be substantially identical, whereby the manufacture of one type of coupling device can be utilized for both interconnections. Accordingly, one coupling device can be rotated 90 degrees relative to the other coupling device to provide the arrangement shown in FIG. 1. Likewise, one coupling device can face in one direction and the other coupling device can face in an opposite direction in order to be connected to the pipes as shown in FIG. 1. Therefore, only one coupling device need be described for an understanding of the present invention, where the structure of the coupling device 28 is set forth below.

Figure 2:
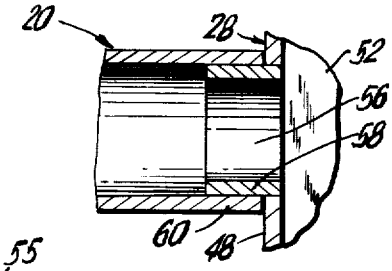
FIG. 2 is a sectional view taken along line 2—2 of FIG. 1.
Figure 3:
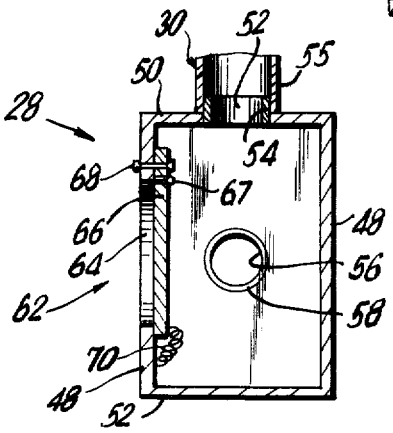
FIG. 3 is a sectional view taken along line 3—3 of FIG. 1.
Figure 4:
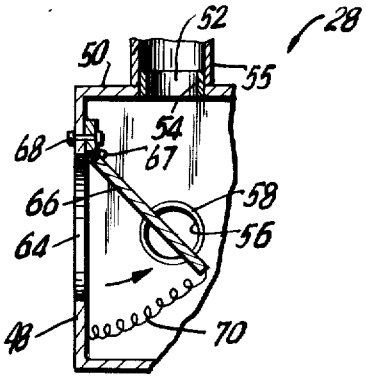
FIG. 4 is a view similar to that shown in FIG. 3, showing the operation of the safety means.

Referring now to FIGS. 2–4, there is shown details of the coupling device 28. The coupling device is generally of a rectangular shape, box-like arrangement including sidewalls 48, a top wall 50 and a bottom wall 52. The top wall 50 contains an opening 52 with a neck portion 54 extending upward from the top. The neck 54 is capable of mating within an end portion 55 of pipe 30 which fits over the neck. The end portion 55 can be retained by means of an interference fit, or can be coupled to the neck portion 54 by means of screws, soldering, or other fastening means. Positioned on one of the sidewalls is a second opening 56 which is situated transversely to the opening 52. The opening 56 also contains a neck portion 58 extending outwardly therefrom which mates with a further end portion 60 of the pipe 20 in the same manner as set forth above.

On one of the widewalls 48 perpendicular to the wall containing the opening 56 is located a safety means, shown generally at 62, and including an opening 64 with a cover or plate 66 pivotally attached to the wall of the device by means of a screw arrangement 68 so that it can cover the opening 64. The cover 66 is preferably formed from a large section and a small section which are pivotally connected together by convention hinge means 67. The small section is secured by the screws 68 to the sidewall 48 with the large section covering the opening 64. A normally compressed spring 70 biases the large section of the cover 66 into a closed position covering the opening 64. The cover can also be formed from one thin piece of flexible material which can deflect under pressure so that the hinge means are not required, where the resilient character of the material would hold the cover closed against the opening 64 so that the spring 70 would not be required either, the cover itself acting as a spring when secured by the screws 68 at the end thereof.

In normal operation, the cover 66 closes the opening 64 thereby preventing the air inside the building from getting into the coupling means and into the heating system. The air from outside the building will therefore be the only air passing through the coupling devices for the heating system. The air from outside the building will therefore be the only air passing through the coupling devices for the heating system. However, should the air flow from the outside become restricted, blocked or even greatly reduced, the pressure inside the coupling device will be reduced, and the air from inside the building will press against the cover 66 and act against the tension of biasing spring 70 to force the large section of the cover 66 to pivot open, thereby permitting the flow of air from inside the building to flow into the coupling device and provide air for the air intake of the furnace as well as for proper draft of the flue pipe.

Although a single air duct 40 has been shown for connecting both air supply pipes, it will be understood that separate air ducts and separate apertures could also be provided.

There has been disclosed heretofore the best embodiment of the invention presently contemplated. However, it is to be understood that various changes and modifications may be made thereto without departing from the spirit of the invention.

What is claimed is:

1. A heating system for heating a building comprising a furnace having an inlet and an outlet, a flue pipe leading from said outlet to a first exterior of the building for escape of exhaust gases, a draft opening in said flue pipe, an air intake pipe coupled to said inlet for receiving air into said furnace, first and second pipes respectively having one end thereof coupled to a second exterior of the building, first coupling means interconnecting the other end of said first pipe to said draft opening for allowing air outside of said building to provide a draft to said flue pipe, a second coupling means interconnecting the other end of said second pipe to said air intake pipe for allowing air outside of said building to be used as the air supply for said furnace, and at least one of said coupling means including safety means for admitting air from inside the building when the air flow from outside the building becomes restricted.

2. A heating system as in claim 1, further comprising air duct means positioned on said building for allowing outside air to pass into the building, and wherein both said first and second pipes are connected to said air duct means.

3. A heating system as in claim 1, wherein said first and second coupling means are substantially identical.

4. A heating system as in claim 1, wherein said one of said coupling means includes an opening interconnecting the one coupling means to an interior of the building, said safety means including a plate pivotally covering said opening, and biasing means maintaining said plate in a closed position over said opening.

5. A heating system for heating a building comprising a furnace having an inlet and an outlet, a flue pipe leading from said outlet to a first exterior of the building for escape of exhaust gases, a draft opening in said flue pipe, an air intake pipe coupled to said inlet for receiving air into said furnace, first and second pipes respectively having one end thereof coupled to a second exterior of the building, first coupling means interconnecting the other end of said first pipe to said draft opening for allowing air outside of said building to provide a draft to said flue pipe, a second coupling means interconnecting the other end of said second pipe to said air intake pipe for allowing air outside of said building to be used as the air supply for said furnace, and at least one of said coupling means including a housing, a first aperture in a first portion of said housing capable of receiving one pipe, and a second aperture in a second portion of said housing capable of receiving another pipe.

6. A heating system as in claim 5, wherein said first and second coupling means are substantially identical.

7. A heating system as in claim 5, wherein said housing has a substantially rectangular configuration, said first portion being a top of said housing, and said second portion being a sidewall of said housing.

8. A heating system as in claim 5, wherein each of said apertures includes a neck portion extending outwardly from said housing for respectively coupling to the pipes.

9. A heating system as in claim 5, further comprising safety means for admitting air from inside the building when the air flow from outside the building becomes restricted.

10. A heating system as in claim 9, wherein said housing includes an opening in one wall thereof, said safety means including a plate pivotally covering said opening, and biasing means maintaining said plate in a closed position covering said opening.

11. A heating system as in claim 10, wherein said biasing means is a normally compressed spring.

12. A heating system as in claim 5, further comprising air duct means positioned on said building for allowing outside air to pass into the building, and wherein both said first and second pipes are connected to said air duct means.

* * * * *